US009314843B2

(12) United States Patent
Maeda et al.

(10) Patent No.: US 9,314,843 B2
(45) **Date of Patent: *Apr. 19, 2016**

(54) POWDER FOR MAGNET

(75) Inventors: Toru Maeda, Itami (JP); Asako Watanabe, Itami (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 8 days.

This patent is subject to a terminal disclaimer.

(21) Appl. No.: 13/496,069

(22) PCT Filed: Apr. 13, 2011

(86) PCT No.: PCT/JP2011/059183

§ 371 (c)(1),
(2), (4) Date: Mar. 14, 2012

(87) PCT Pub. No.: WO2011/129366

PCT Pub. Date: Oct. 20, 2011

(65) Prior Publication Data

US 2012/0237769 A1 Sep. 20, 2012

(30) Foreign Application Priority Data

Apr. 15, 2010 (JP) ..... 2010-093875
Feb. 22, 2011 (JP) ..... 2011-036281

(51) Int. Cl.

| | |
|---|---|
| ***H01F 1/01*** | (2006.01) |
| ***B22F 3/24*** | (2006.01) |
| ***B22F 3/02*** | (2006.01) |
| ***C23C 8/08*** | (2006.01) |
| ***B22F 1/00*** | (2006.01) |
| ***B22F 3/10*** | (2006.01) |
| ***B22F 9/02*** | (2006.01) |
| ***C22C 33/02*** | (2006.01) |
| ***H01F 41/02*** | (2006.01) |
| *H01F 1/057* | (2006.01) |

(52) U.S. Cl.
CPC . *B22F 3/02* (2013.01); *B22F 3/101* (2013.01); *B22F 3/24* (2013.01); *B22F 9/023* (2013.01); *C22C 33/0278* (2013.01); *H01F 1/0578* (2013.01); *H01F 41/0273* (2013.01); *H01F 1/0573* (2013.01); *Y10T 428/2982* (2015.01)

(58) Field of Classification Search
None
See application file for complete search history.

(56) References Cited

U.S. PATENT DOCUMENTS 3,684,499 A 8/1972 Hofer et al.
5,474,623 A 12/1995 Ma et al.

(Continued)

FOREIGN PATENT DOCUMENTS

CN 1100228 A 3/1995
CN 1230755 A 10/1999

(Continued)

OTHER PUBLICATIONS

Chinese Office Action for corresponding Chinese Patent Application No. 201180003841.2 dated Aug. 15, 2013, 21 pages.
Office Action for Japanese Patent Application No. 2011-036281 dated Apr. 9, 2012, pp. 1-2.
Notice of decision to grant a patent for Corresponding Korean application No. 10-2012-7005937 dated Nov. 20, 2013.
International Search Report for International Application No. PCT/JP2011/060744, mailed Aug. 9, 2011, 2 pages.

(Continued)

*Primary Examiner* — Ronak Patel
(74) *Attorney, Agent, or Firm* — Ditthavong & Steiner, P.C.

(57) ABSTRACT

The present invention provides a powder for a magnet which can form a rare earth magnet having excellent magnetic characteristics and which has excellent moldability, a method for producing the powder for a magnet, a powder compact, and a rare earth-iron-boron-based alloy material.

4 Claims, 1 Drawing Sheet

(56) References Cited

U.S. PATENT DOCUMENTS

| | | | | |
|---|---|---|---|---|
| 2002/0059965 | A1* | 5/2002 | Honkura et al. | 148/105 |
| 2008/0251159 | A1* | 10/2008 | Odaka et al. | 148/121 |
| 2009/0047594 | A1 | 2/2009 | Hirakawa | |
| 2010/0279105 | A1 | 11/2010 | Pyun et al. | |

FOREIGN PATENT DOCUMENTS

| | | | |
|---|---|---|---|
| CN | 1293435 | A | 5/2001 |
| CN | 1842385 | A | 10/2006 |
| CN | 101615459 | A | 12/2009 |
| JP | 53-078096 | A | 7/1978 |
| JP | 3129702 | A | 6/1991 |
| JP | 10106875 | A | 4/1998 |
| JP | 11-158588 | A | 6/1999 |
| JP | 11-158588 | A | 6/1999 |
| JP | 2003031432 | A | 1/2003 |
| JP | 2004134552 | A | 4/2004 |
| JP | 4029714 | B2 | 10/2007 |
| JP | 2008172037 | A | 7/2008 |
| JP | 2009-123968 | A | 6/2009 |
| JP | 2011137218 | A | 7/2011 |
| KR | 10-2002-0033504 | A | 5/2002 |
| WO | WO 2005/105343 | A1 | 11/2005 |

OTHER PUBLICATIONS

Chinese Office Action for related Chinese Application No. 201180004578.9, dated Oct. 17, 2013, 11 pages.

Notice of decision to grant a patent for related Korean Application No. 1020127010195, dated Jan. 2, 2014, 2 pages.

Chinese Office Action for related Chinese Application No. 201180004578.9, dated Apr. 8, 2014, 17 pages.

Chinese Office Action for related Chinese Application No. 201080055027.0, dated Sep. 3, 2013, 22 pages.

Yu et al., "Effect of HD and HDDR Process on Magnetic Properties of Fe-Based Rare Earth Compound," Metallic Functional Materials, No. 1, pp. 18-21, Feb. 28, 1997 (with English Language Abstract).

Zhang et al., "Development and Characteristics of Nd—Fe—B Powder Preparation," Powder Metallurgy Technology, No. 6, pp. 465-469, Dec. 30, 2005 (with English Language Abstract).

International Search Report for related PCT Application No. PCT/JP2010/071604, dated Mar. 8, 2011, 1 page.

Notification of Reasons for Rejection for related Japanese Application No. 2010-253753, dated Apr. 9, 2012, 4 pages (with partial English Translation).

International Search Report for PCT Application No. PCT/JP2011/059183 dated Jul. 19, 2011, pp. 1.

* cited by examiner

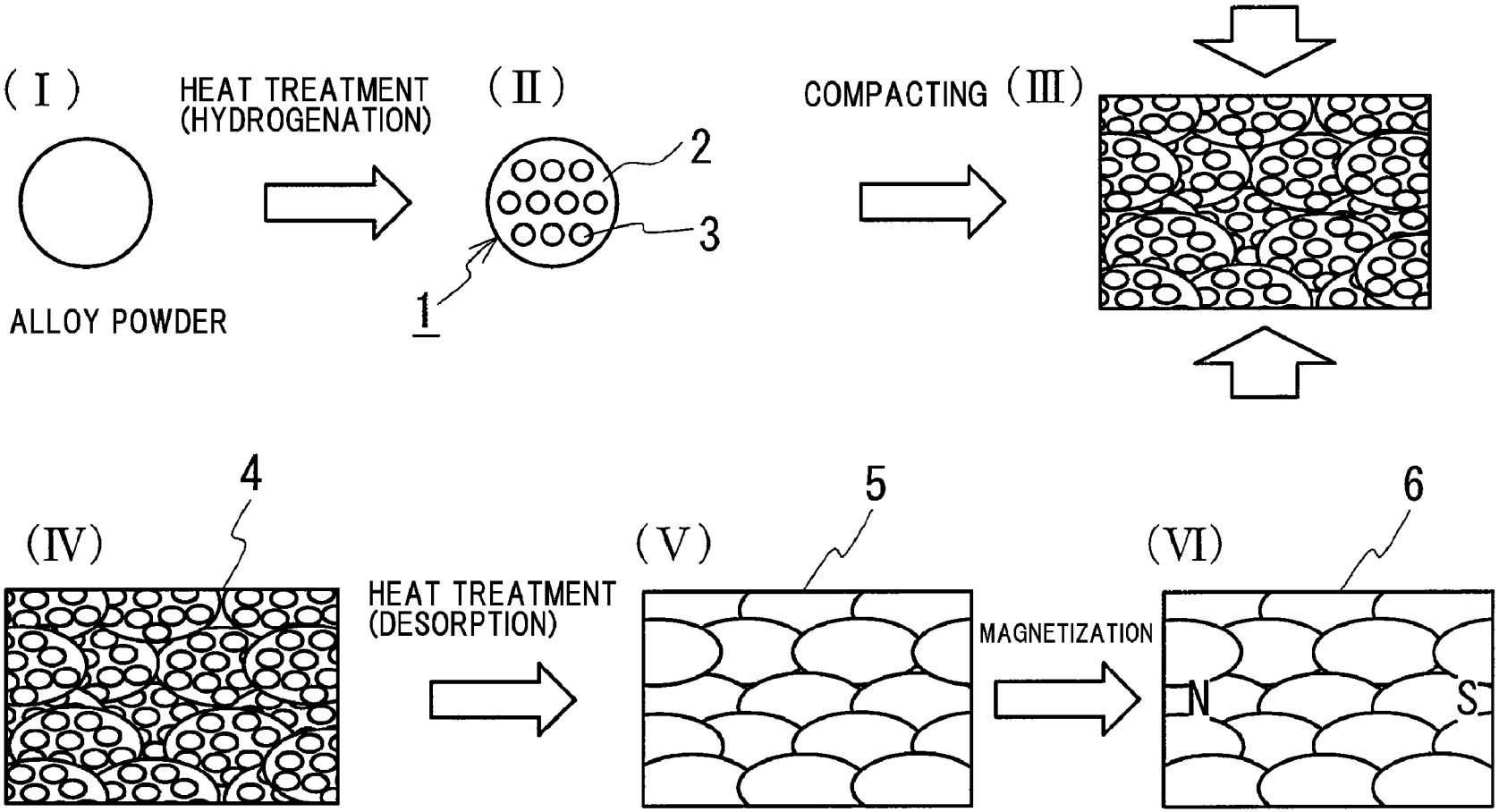
(I)
ALLOY POWDER
HEAT TREATMENT
(HYDROGENATION)
(II)
1
2
3
COMPACTING (III)
(IV)
4
HEAT TREATMENT
(DESORPTION)
(V)
5
MAGNETIZATION
(VI)
6
N
S

POWDER FOR MAGNET

TECHNICAL FIELD

The present invention relates to a powder for a magnet used as a raw material of a rare earth-iron-boron-based magnet, a method for producing the powder for a magnet, a powder compact formed from the powder, a rare earth-iron-boron-based alloy material, and a method for producing the alloy material. In particular, the present invention relates to a powder for a magnet which has excellent moldability and which can form a powder compact having a high relative density.

BACKGROUND ART

Rare earth magnets are widely used as permanent magnets for motors and power generators. Typical examples of the rare earth magnets include sintered magnets and bond magnets each of which is composed of a R—Fe—B-based alloy (R: a rare earth element, Fe: iron, B: boron), such as Nd (neodymium)—Fe—B.

Sintered magnets are each produced by compacting a powder composed of a R—Fe—B-based alloy and then sintering the molded product, and bond magnets are each produced by mixing an alloy powder composed of a R—Fe—B-based alloy with a binder resin and then compacting or injection-molding the resultant mixture. In particular, the powders used for the bond magnets are subjected to hydrogenation-disproportionation-desorption-recombination treatment (HDDR treatment, HD: hydrogenation and disproportionation, DR: desorption and recombination) in order to enhance coercive force.

Sintered magnets are excellent in magnet characteristics because of the high ratio of magnetic phase, but have a small degree of freedom of shape and are thus difficult to form into complicated shapes such as a cylindrical shape, a columnar shape, and a pot shape (cylindrical shape with a bottom). In the case of a complicated shape, cutting of a sintered material is required. On the other hand, bond magnets have a high degree of freedom of shape but have magnet characteristics inferior to those of the sintered magnets. In response to this, Patent Literature 1 discloses that a fine alloy powder composed of a Nd—Fe—B-based alloy is compacted to form a green compact (powder compact), and the green compact is subjected to HDDR treatment to increase the degree of freedom of shape and produce a magnet having excellent magnet characteristics.

CITATION LIST

Patent Literature

PTL 1: Japanese Unexamined Patent Application Publication No. 2009-123968

SUMMARY OF INVENTION

Technical Problem

As described above, sintered magnets have excellent magnet characteristics but have a low degree of freedom of shape, while bond magnets have a high degree of freedom of shape but have a magnetic phase ratio of about 80% by volume at most because of the presence of a binder resin and thus have difficulty in increasing the ratio of magnetic phase. Therefore, it is desired to develop a material for a rare earth magnet which can be easily produced with a high magnetic phase ratio and a complicated shape.

An alloy powder composed of an Nd—Fe—B-based alloy disclosed in PTL 1 and a powder produced by HDDR treatment of the alloy powder contain constituent particles which have high rigidity and are thus hardly deformed. Therefore, in order to produce a rare earth magnet having a high magnetic phase ratio without sintering, relatively high pressure is required for producing a powder compact with a high relative density by compacting. In particular, when an alloy powder is composed of coarse particles, higher pressure is required. Therefore, it is demanded to develop a raw material which can be easily molded into a powder compact having a high relative density.

In addition, HDDR treatment of a green compact as described in PTL 1 may cause breakage of the resultant porous body for a magnet due to expansion-contraction of the green compact during the treatment. Therefore, it is demanded to develop a raw material which can produce a rare earth magnet causing little breakage during production and having satisfactory strength and excellent magnet characteristics, and a method for producing the raw material.

Accordingly, an object of the present invention is to provide a powder for a magnet which has excellent moldability and which can form a powder compact with a high relative density. Another object of the present invention is to provide a method for producing the powder for a magnet.

A further object of the present invention is to provide a powder compact suitable as a raw material for a rare earth magnet which has excellent magnetic characteristics and is composed of a rare earth-ion-boron-based alloy, a rare earth-iron-boron-based alloy material, and a method for producing the alloy material.

Solution to Problem

In order to increase a ratio of magnetic phase in a rare earth magnet and to produce a magnet having excellent magnet characteristics without sintering, the inventors researched the use of powder molding, not molding for forming a bond magnet using a binder resin. As described above, usual raw material powders, i.e., an alloy powder composed of a Nd—Fe—B-based alloy and a treated powder produced by HDDR treatment of the alloy powder, are hard and little deformable and thus have low moldability by compacting and difficulty in improving the density of a powder compact. Therefore, as a result of various researches for enhancing moldability, the inventors found that when a powder does not have a compound state like a rare earth-iron-boron-based alloy, in which a rare earth element and iron are bonded together, but has a structure in which a rare earth element and iron are not bonded, that is, an iron component and an iron-boron alloy component are present independently of a rare earth element, the powder has high deformability and excellent moldability, thereby producing a powder compact having a high relative density. It was also found that a powder having the specified structure can be produced by specified heat treatment of an alloy powder composed of a rare earth-iron-boron-based alloy. In addition, a powder compact produced by compacting the resultant powder is subjected to specified heat treatment to produce a rare earth-iron-born-based alloy material similar to those produced from a green compact subjected to HDDR treatment and a compact produced using treated powder subjected to HDDR treatment. In particular, a rare earth magnet having a high ratio of magnetic phase and excellent magnetic characteristics, specifically a rare earth-iron-boron-based alloy magnet, can be produced using a rare earth-iron-boron-based alloy material produced from a powder compact having a high relative density. The present invention is based on these findings.

A powder for a magnet of the present invention is a powder used for a rare earth magnet and includes magnetic particles which constitute the powder for a magnet and each of which is composed of less than 40% by volume of a hydrogen compound of a rare earth element, and the balance composed of an iron-containing material. The iron-containing material contains iron and an iron-boron alloy containing iron and boron. In each of the magnetic particles, a phase of the hydrogen compound of a rare earth element and a phase of the iron-containing material are present adjacent to each other, and the distance between the phases of the rare earth element hydrogen compound adjacent to each other with the phase of the iron-containing material disposed therebetween is 3 μm or less.

The powder for a magnet of the present invention can be produced by a method for producing a powder for magnet according to the present invention described below. The production method is a method for producing a powder for a magnet used for a rare earth magnet and includes a preparation step and hydrogenation step described below, wherein each of magnetic particles which constitute the powder for a magnet is composed of less than 40% by volume of a hydrogen compound of a rare earth element, and the balance composed of an iron-containing material, the iron-containing material containing iron and an iron-boron alloy containing iron and boron. In addition, a phase of the hydrogen compound of a rare earth element and a phase of the iron-containing material are present adjacent to each other, and the distance between the phases of the rare earth element hydrogen compound adjacent to each other with the phase of the iron-containing material provided therebetween is 3 μm or less.

Preparation step: A step of preparing an alloy powder composed of a rare earth-iron-boron-based alloy Hydrogenation step: A step of heat-treating the alloy powder in an atmosphere containing hydrogen element at a temperature equal to or higher than the disproportionation temperature of the rare earth-iron-boron-based alloy to produce the powder for a magnet.

Each of the magnetic particles constituting the powder for a magnet of the present invention includes a plurality of phases including the phase of the iron-containing material and the phase of the hydrogen compound of a rare earth element, but not a single layer of a rare earth alloy like an R—Fe—B-based alloy or R—Fe—N-based alloy. The phase of the iron-containing material is soft and rich in moldability as compared with the R—Fe—B-based alloy and R—Fe—N-based alloy and the hydrogen compound of a rare earth element. In addition, each of the magnetic particles constituting the powder for a magnet of the present invention contains, as a main component (60% by volume or more), the iron-containing material containing iron so that the phase of the iron-containing material in the magnetic particles can be sufficiently deformed by compacting the powder for a magnet of the present invention. Further, as described above, the phase of the iron-containing material is present between the phases of the hydrogen compound of a rare earth element. That is, the phase of the iron-containing material is uniformly present without being localized in each of the magnetic particles constituting the powder, and thus each of the magnetic particles is uniformly deformed by compacting. Consequently, by using the powder for a magnet of the present invention, a powder compact (powder compact of the present invention) having a high relative density can be produced. In addition, by using the powder compact having a high relative density, a rare earth-iron-boron-based alloy material (rare earth-iron-boron-based alloy material of the present invention) having a high magnetic phase ratio can be produced without sintering, and a rare earth magnet having a high magnetic phase ratio can be produced using the rare earth-iron-boron-based alloy material. Further, since the magnetic particles are engaged and bonded together by sufficient deformation of the iron-containing material, a rare earth magnet having a magnetic phase ratio of 80% by volume or more, preferably 90% by volume or more, can be produced without including a binder resin unlike in a bond magnet.

In addition, the powder compact produced by compacting the powder for a magnet of the present invention does no undergo sintering unlike in a sintered magnet, and thus has no shape limit due to contraction anisotropy caused by sintering and has a high degree of freedom of shape. Therefore, by using the powder for a magnet of the present invention, a complicated shape, for example, a cylindrical shape, a columnar shape, or a pot shape, can be easily formed substantially without cutting or the like. Further, cutting is not required, and thus the raw material yield can be remarkably improved, and productivity of a rare earth magnet can be improved.

Further, as described above, the powder for a magnet of the present invention can be easily produced by heat-treating the rare earth-iron-boron-based alloy powder in an atmosphere containing hydrogen elements at a specified temperature.

Further, as described above, the powder for a magnet of the present invention has excellent moldability and thus can be made a relatively coarse powder, and a coarse powder of about 100 μm can be used as a raw material powder. Therefore, in producing the powder for a magnet of the present invention, a powder produced by roughly grinding a melt cast ingot to an average particle diameter of about 100 μm, or a powder produced by an atomization method (e.g., a molten metal atomizing method) can be used as a raw material powder. In a sintered magnet and a bond magnet, a fine powder of 10 μm or less is used as a raw powder for forming a molded product before sintering or a raw material to be mixed with a resin. The powder for a magnet of the present invention is produced using the above-described coarse powder as a raw material, and a grinding step of finely grinding the raw powder to a fine powder of 10 μm or less is not required, thereby permitting an attempt to decrease the cost by shortening the production process.

Advantageous Effects of Invention

The powder for a magnet of the present invention has high moldability and produces the powder compact with a high relative density of the present invention. A rare earth magnet having a high magnetic phase ratio is produced using the powder compact of the present invention or the rare earth-iron-boron-based alloy material of the present invention. The method for producing a powder for a magnet of the present invention and the method for producing a rare earth-iron-boron-based alloy material of the present invention are capable of producing the powder for a magnet of the present invention and the rare earth-iron-boron-based alloy material of the present invention, respectively, with high productivity.

BRIEF DESCRIPTION OF DRAWINGS

FIG. 1 is an explanatory process drawing illustrating an example of a process for producing a magnet using a powder for a magnet of the present invention.

DESCRIPTION OF EMBODIMENTS

The present invention is described in further detail below.

[Powder for Magnet]

Magnetic particles constituting a powder for a magnet of the present invention each contain an iron-containing material as a main component at a content of 60% by volume or more. When the content of the iron-containing material is less than 60% by volume, a hydrogen compound of a rare earth element, which is a hard component, is relatively increased in amount, and thus the iron-containing component is not easily sufficiently deformed during compacting, while when the content of the iron-containing material is excessively high, magnetic characteristics are degraded. Therefore, the content is preferably 90% by volume or less.

The iron-containing material contains both iron and an iron-boron alloy. The iron-boron ally is, for example, $Fe_3B$. In addition to the iron-boron alloy, pure iron (Fe) is added in order to improve moldability. The content of the iron-boron alloy is preferably 10% to 40% in terms of ratio by mass relative to 100% of the iron-containing material. When the content of the iron-boron alloy is 10% by mass or more, an iron single phase is little precipitated, and thus decrease in magnetic characteristics due to a large amount of iron single phase is easily suppressed. When the content is 40% by mass or less, moldability is excellent. The ratio of iron to the iron-boron alloy in the iron-containing material can be determined by, for example, measuring X-ray diffraction peak intensities (peak areas) and comparing the measured peak intensities. In addition, the iron-containing material may have a form in which iron is partially replaced by at least one element selected from Co, Ga, Cu, Al, Si, and Nb. In the form of the iron-containing material containing such an element, magnetic characteristics and corrosion resistance of a rare earth magnet can be improved.

On the other hand, if the magnetic particles do not contain the hydrogen compound of a rare earth element, a rare earth magnet cannot be produced. The content of the hydrogen compound of a rare earth element is over 0% by volume, and preferably 10% by volume or more and less than 40% by volume. The content of the iron-containing material or the hydrogen compound of a rare earth element and the ratio of iron to the iron-boron alloy can be adjusted by appropriately changing the composition of a rare earth-iron-boron-based alloy used as a raw material of the powder, and heat treatment conditions (mainly the temperature) for producing the powder. Each of the magnetic particles constituting the powder for a magnet is allowed to contain unavoidable impurities.

The rare earth element contained in each of the magnetic particles which constitute the powder for a magnet of the present invention is at least one element selected from Sc (scandium), Y (yttrium), lanthanides, and actinides. In particular, at least one element selected from Nd, Pr, Ce, Dy, and Y is preferably contained, and Nd (neodymium) is particularly preferred because an R—Fe—B-based alloy magnet having excellent magnetic characteristics can be produced. Examples of the hydrogen compound of a rare earth element include $NdH_2$ and $DyH_2$.

Each of the magnetic particles which constitute the powder for a magnet of the present invention has a structure in which a phase of the hydrogen compound of a rare earth element and a phase of the iron-containing material are present at a specified distance therebetween as described above, simply stated, a structure in which both phases are uniformly separately present. Typical examples of the structure include a layered form in which both phases are present in a layered structure, and a disperse form in which the phase of the hydrogen compound of a rare earth element is granular, and the granular hydrogen compound of a rare earth element is dispersed in the phase of the iron-containing material serving as a mother phase.

Depending on the heat treatment conditions (mainly the temperature) for producing the powder for a magnet of the present invention, the presence form of both phases tends to become the disperse form at the increased temperature and become the layered form at the temperature close to a disproportionation temperature.

By using the powder having the layered form, a rare earth magnet having, for example, a magnetic phase ratio equal to that (about 80% by volume) of a bond magnet can be formed without using a binder resin. In the case of the layered form, the sentence "the phase of the hydrogen compound of a rare earth element and the phase of the iron-containing material are adjacent to each other" represents a condition in which both phases are substantially alternately laminated in a cross-section of each of the magnetic particles constituting the powder for a magnet. In addition, in the case of the layered form, the expression "the distance between the adjacent phases of the hydrogen compound of a rare earth element" refers to, in the cross-section, the center-to-center distance between the phases of the hydrogen compound of a rare earth element adjacent to each other with the phase of the iron-containing material disposed therebetween.

In the disperse form, the iron-containing material component is uniformly present around the particles composed of the hydrogen compound of a rare earth element, and thus the iron-containing material component can be more easily deformed than in the layered form. For example, a powder compact having a complicated shape such as a cylindrical shape, a columnar shape, or a pot shape, and a high-density powder compact having a relative density of 85% or more, particularly 90% or more, can be easily formed. In the case of the disperse form, the sentence "the phase of the hydrogen compound of a rare earth element and the phase of the iron-containing material are adjacent to each other" typically represents a condition in which in a cross-section of each of the magnetic particles constituting the powder for a magnet, the iron-containing material is present to cover the peripheries of particles of the hydrogen compound of a rare each element, and the iron-containing material is present between the adjacent particles of the hydrogen compound of a rare earth element. In addition, in the case of the disperse form, the expression "the distance between the adjacent phases of the hydrogen compound of a rare earth element" refers to, in the cross-section, the center-to-center distance between the adjacent particles of the hydrogen compound of a rare earth element.

The distance can be measured by, for example, removing the phase of the iron-containing containing material by etching the section to extract the hydrogen compound of a rare earth element, by removing the hydrogen compound of a rare earth element to extract the iron-containing material according to the type of the solution used, or by analyzing the composition of the section with an EDX (energy dispersive X-ray spectroscopy) apparatus. With the distance of 3 μm or less, input of excessive energy is not required for appropriately heat-treating the powder compact using the powder to convert a mixed structure containing the iron-containing material and the hydrogen compound of a rare earth element into a rare earth-iron-boron-based alloy, thereby forming a rare earth-iron-boron-based alloy material. In addition, a decrease in characteristics due to coarsening of rare earth-iron-boron-based alloy crystals can be suppressed. In order to allow the iron-containing material to be sufficiently present between the phases of the hydrogen compound of a rare earth element, the distance is preferably 0.5 μm or more, particularly 1 μm or more. The distance can be adjusted by controlling the composition of the rare earth-iron-born-based alloy powder used as a raw material or controlling the heat treatment conditions, particularly the temperature, of the heat treatment for producing the powder for a magnet within a specified range. For example, the distance tends to be increased by increasing the ratio (atomic ratio) of iron or boron in the rare earth-iron-boron-based alloy powder or increasing the temperature of the heat treatment (hydrogenation) within the specified range.

The average particle diameter of the magnetic particles constituting the powder for magnet of the present invention is particularly preferably 10 μm or more and 500 μm or less. With a relatively large particle diameter of 10 μm or more, the ratio (referred to as a "occupancy ratio" hereinafter) of the hydrogen compound of a rare earth element in the surface of each magnetic particle can be relatively decreased. In this case, a rare earth element is generally liable to oxidize. However, the powder satisfying the average particle diameter little oxidizes due to the low occupancy ratio and thus can be handled in air. Therefore, for example, the powder compact can be formed in air, improving the productivity of the powder compact. In addition, the powder for a magnet of the present invention contains the phase of the iron-containing material and thus has excellent moldability as described above, and thus a powder compact having low porosity and a high relative density can be formed even by using a coarse powder having an average particle diameter of 100 μm or more. However, an excessively large average particle diameter causes a decrease in relative density of the powder compact, and thus the average particle diameter is preferably 500 μm or less. The average particle diameter is more preferably 50 μm or more and 200 μm or less.

Further, the powder for a magnet of the present invention may have a form in which an insulating coating composed of an insulating material is provided on the periphery of each of the magnetic particles. By using the powder provided with the insulating coating, a rare earth magnet having a high electric resistance is formed, and for example, an eddy-current loss can be decreased by using this magnet for a motor. Examples of the insulating coating include crystalline and amorphous glass coatings of oxides of Si, Al, Ti, and the like; coatings of metal oxides such as ferrite represented by Me—F—O (Me=metal element such as Ba, Sr, Ni, Mn, or the like), magnetite ($Fe_3O_4$), and $Dy_2O_3$; coatings of resins such as silicone resins; and coatings of organic-inorganic hybrid compounds such as silsesquioxane compounds. The crystalline coatings, glass coatings, oxide coatings, and ceramic coatings may have an antioxidant function. In this case, oxidation of the magnetic particles can also be presented. In addition, a SiN or Si—C-based ceramic coating may be provided for improving thermal conductivity. In the case of the powder provided with the coating such as the insulating coating, the shape of each of the magnetic particles constituting the powder is preferably close to a spherical shape in order to suppress damage to the coating during compacting.

For the powder for a magnetic used for other rare earth magnets, for example, a rare earth-iron-carbon-based alloy magnet, a form in which the iron-containing material contains iron and an iron-carbon alloy containing iron and carbon can be used. Like the powder containing the iron-boron alloy, the powder containing the iron-carbon alloy can also be produced by heat-treating an alloy powder composed of a rare earth-iron-carbon-based alloy at a temperature equal to or higher than the disproportionation temperature of the rare earth-iron-carbon-based alloy in an atmosphere containing hydrogen elements. In each of the items described above and below, the terms "iron-boron alloy" and "rare earth-iron-boron-based alloy" can be replaced by the terms "iron-carbon alloy" and "rare earth-iron-carbon-based alloy". Typical examples of the rare earth-iron-carbon-based alloy include $Nd_2Fe_{14}C$.

[Method for Producing Powder for Magnet]

The powder for a magnet can be produced by preparing an alloy powder (e.g., $Nd_2Fe_{14}B$) composed of a rare earth-iron-boron-based alloy and heat-treating the alloy powder in an atmosphere containing hydrogen elements to separate the rare earth element, iron, and the iron-boron alloy from each other in the alloy and, at the same time, to combine the rare earth element and hydrogen. The alloy powder can be produced by, for example, grinding a melt cast ingot composed of a rare earth-iron-boron-based alloy or a foil-shaped material, which his obtained by a rapid solidification method, with a grinder such as a jaw crusher, a jet mill, or a ball mill, or by using an atomization method such as a gas atomization method. In particular, use of the gas atomization method can form a powder (oxygen concentration: 1000 ppm by mass or less, preferably 500 ppm by mass or less) containing substantially no oxygen by forming the powder in a non-oxidizing atmosphere. That is, in the magnetic particles constituting the alloy powder, the oxygen concentration of 1,000 ppm by mass or less can be used as an index which indicates a powder produced by the gas atomization method in a non-oxidizing atmosphere. In addition, as the alloy powder composed of the rare earth-iron-boron-based alloy, a powder produced by a known powder producing method or the atomization method and further grinding the powder may be used. The particle size distribution and the shape of the magnetic particles of the powder for a magnet can be adjusted by appropriately changing the grinding conditions or the production conditions. For example, a powder having high sphericity and excellent filling properties during molding can be easily produced by the atomization method. The magnetic particles constituting the powder for a magnet may be each composed of a polycrystal or a single crystal. Particles composed of a single crystal can be formed by appropriate heat treatment of magnetic particles composed of a polycrystal.

The size of the alloy powder prepared in the preparation step is substantially the same as the powder for a magnet of the present invention when the heat treatment for hydrogenation in a subsequent step is performed so as substantially not to change the particle size. Since the powder of the present invention is excellent in moldability as described above, for example, the powder can be made relatively coarse to have an average particle diameter of about 100 μm. Therefore, in the preparation step, the alloy powder having an average particle diameter of about 100 μm can be used.

As the atmosphere containing hydrogen elements, a single atmosphere containing only hydrogen ($H_2$), or a mixed atmosphere containing hydrogen ($H_2$) and inert gas, such as Ar or $N_2$, can be used. The heat treatment temperature in the hydrogenation step is equal to or higher than the temperature at which disproportionation reaction of the rare earth-iron-boron-based alloy proceeds, i.e., the disproportionation temperature. The disproportionation reaction is a reaction of separating the hydrogen compound of a rare earth element, ion, and the iron-boron alloy from each other by preferential hydrogenation of the rare earth element, and the lower limit temperature at which the reaction takes place is referred to as the disproportionation temperature. The disproportionation temperature varies with the composition of the alloy and the type of the rare earth element. For example, when the rare earth-iron-boron-based alloy is $Nd_2Fe_{14}B$, the heat treatment temperature is, for example, 650° C. or more. With the heat treatment temperature near the disproportionation temperature, the above-described layered form is produced, while with the heat treatment temperature 100° C. or more higher than the disproportionation temperature, the above-described disperse form is produced. As the higher the heat treatment temperature in the hydrogenation step is, the more easily the iron phase and the iron-boron alloy phase appear, and the less the hard hydrogen compound of a rare earth element, which is precipitated at the same time, becomes a inhibitor factor to deformation, thereby enhancing moldability. However, with an excessively high heat treatment temperature, a trouble such as melt fixing occurs, and thus the heat treatment temperature is preferably 1100° C. or less. In particular, when the rare earth-iron-boron-based alloy is $Nd_2Fe_{14}B$, with the relatively low heat treatment temperature of 750° C. or more and 900° C. or less in the hydrogenation step, a fine structure having the small distance is realized, and a rare earth magnet having high coercive force can be easily formed by using such a powder. The retention time is, for example, 0.5 hours or more and 5 hours or less. The heat treatment corresponds to the treatment up to the disproportionation step of the above HDDR treatment, and known disproportionation conditions can be applied.

[Powder Compact]

A powder compact of the present invention can be produced through a molding step of molding a powder compact by compacting the powder for a magnet of the present invention. Since the powder for a magnet of the present invention has excellent moldability as described above, the powder compact having a high relative density (actual density relative to the true density of the powder compact) can be formed. For example, a form of the powder compact of the present invention has a relative density of 85% or more, still more, 90% or more. By using the powder compact having such a high density, a rare earth magnet having a high ratio of magnetic phase can be produced. Since the ratio of magnetic phase is increased by increasing the relative density, the upper limit of the relative density is not particularly provided.

In addition, since the powder for a magnet of the present invention has excellent moldability, the pressure of compacting can be decreased to a relatively low value, for example, 8 ton/cm$^2$ or more and 15 ton/cm$^2$ or less. Further, since the powder for a magnet of the present invention has excellent moldability, even a powder compact with a complicated shape can be easily formed. In addition, since the powder for a magnet of the present invention includes the magnetic particles each of which can be sufficiently deformed, it is possible to produce a powder compact having excellent bondability between the magnetic particles (development of strength (so-called necking strength) produced by engagement between surface projections and recesses of the magnetic particles) and high strength and being little breakable during production.

In addition, deformation can be accelerated by appropriately heating a mold for molding during compacting, so that a powder compact having a high density can be easily produced. Further, a nonoxidizing atmosphere for compacting can desirably prevent oxidation of the powder for a magnet of the present invention.

[Rare Earth-Iron-Boron-Based Alloy Material and Method for Producing the Same]

A rare earth-iron-boron-based alloy material of the present invention can be produced by removing hydrogen from the hydrogen compound of a rare earth element and, at the same time, combining iron, the iron-boron alloy, and the rare earth element separated from hydrogen through a desorption step of heat-treating (dehydrogenating) the powder compact in a nonhydrogen atmosphere so as to avoid reaction with the magnetic particles and efficiently remove hydrogen. The rare earth-iron-boron-based alloy material of the present invention has a single form including substantially the phase of the rare earth-iron-boron-based alloy, or a mixed form (form including mixed phases) including a combination of the rare earth-iron-boron-based alloy phase and at least one phase selected from the iron phase, the iron-born alloy phase, and the rare earth-iron alloy phase. Examples of the mixed form include a form including the iron phase and the rare earth-iron-boron-based alloy phase, a form including the iron-boron alloy phase and the rare earth-iron-boron-based alloy phase, or a form including the rare earth-iron alloy phase and the rare earth-iron-boron-based alloy phase. An example of the single form is a form having substantially the same composition as the rare earth-iron-boron-based alloy used as a raw material for the powder for a magnet of the present invention. The mixed form is typically changed depending on the composition of the rare earth-iron-boron-based alloy used as a raw material, and for example, the form including the iron phase and the rare earth-iron-boron alloy phase can be formed by using a raw material having a high iron ratio (atomic ratio).

The nonhydrogen atmosphere is an inert atmosphere (for example, an inert gas atmosphere of Ar or $N_2$) or a reduced-pressure atmosphere (a vacuum atmosphere at pressure lower than the standard atmospheric pressure). In particular, the reduced-pressure atmosphere is preferred because the rare earth-iron-boron alloy is completely formed leaving little the hydrogen compound of a rare earth element, thereby producing the rare earth-iron-boron-based alloy material of the present invention having excellent magnetic characteristics. In the case of the vacuum atmosphere, the final degree of vacuum is preferably 10 Pa or less.

The temperature of desorption is equal to or higher than the recombination temperature (the temperature of combination of the separated iron-containing material and rare earth element) of the powder compact. The recombination temperature varies depending on the composition of the powder compact (the magnetic particles constituting the molded product), but is typically 700° C. or more. The higher the temperature, the more sufficiently hydrogen can be removed. However, when the desorption temperature is excessively high, the rare earth element having a high vapor pressure may be decreased in amount by evaporation or the coercive force of a rare earth magnet may be decreased due to coarsening of rare earth-iron-boron-based alloy crystals. Therefore, the temperature is preferably 1000° C. or less. The retention time is, for example, 10 minutes or more and 600 minutes (10 hours) or less. The desorption corresponds to DR treatment of the HDDR treatment, and known DR treatment conditions can be applied.

The heat treatment in the desorption step can be performed with a magnetic field of 4 T or more applied to the powder compact.

The inventors found that a rare earth magnet having more excellent magnetic characteristics can be produced by the heat treatment in the desorption step while applying a strong magnetic field to the powder compact. The reason for this is considered as follows. In the simple desorption of the powder compact, initial crystal nuclei composed of the rare earth-iron-boron-based alloy (e.g., $Nd_2Fe_{14}B$) and generated in the structure of the magnetic particles, which constitute the powder compact, assume a state where electron directions are easily disordered (easily made random) by the influence of thermal disturbance due to the heating temperature higher than the Curie temperature during desorption. Therefore, it is considered that the rare earth-iron-boron-based alloy material having random crystal orientations is produced. However, when a high magnetic field is applied during the desorption, electron directions in initial crystal nuclei are changed by the magnetic field to form crystals oriented in a constant direction, thereby producing the rare earth-iron-boron-based alloy material including crystals with the constant orientation. It is also considered that the rare earth-iron-boron-based alloy material including crystals oriented in a direction has excellent magnetic characteristics because the magnetisms of crystals are little canceled with each other as compared with the case of random orientations.

In this case, the magnetic field used for magnetizing a rare earth magnet is generally about 2 T. As shown in test examples described below, desorption with such a degree of magnetic field applied causes a small degree of improvement or substantially no improvement in magnetic characteristics. On the other hand, the rare earth-iron-boron-based alloy material having excellent magnetic characteristics can be produced by the desorption with the specified strong magnetic field applied. The applied magnetic field is preferably as high as possible and 4 T or more.

The rare earth-iron-boron-based alloy material produced by heat treatment of the powder compact with the magnetic field of 4 T or more applied in the inert atmosphere or reduced-pressure atmosphere exhibits constant orientation as described above. The expression "having constant orientation" represents that for example, when an X-ray diffraction pattern of a surface (referred to as a "normal surface" hereinafter) having a normal direction parallel to the direction in which the magnetic field is applied is measured for the rare earth-iron-boron-based alloy material, a diffraction peak appearing at a crystal interplanar spacing of 0.202 nm to 0.240 nm satisfies a relative intensity of 70 or more.

The rare earth-iron-boron-based alloy material mainly having oriented planes with the specified spacing has more excellent magnetic characteristics. In addition, as the relative intensity increases, the magnetic characteristics tend to become more excellent. For example, the relative intensity is 75 or more. The relative intensity is determined by a ratio of measured intensity Ix to reference intensity Imax, $(Ix/Imax)\times 100$, wherein Imax represents the highest peak intensity as a reference intensity among the peak intensities obtained from the normal surface, and Ix represents the measured intensity of a diffraction peak appearing at the crystal interplanar spacing of 0.202 nm to 0.204 nm.

[Rare Earth Magnet]

A rare earth magnet can be produced by appropriately magnetizing the rare earth-iron-boron-based alloy material of the present invention. In particular, by using the above-described powder compact having a high relative intensity, a rare earth magnet having a magnetic phase ratio of 80% by volume or more, still more 90% by volume or more, can be produced.

Embodiments of the present invention are described in further detail below by way of test examples with reference to the drawings. In the drawings, a hydrogen compound of a rare earth element is exaggerated to be easy to understand.

Test Example 1

Various powders each containing a rare earth element, iron, and boron were formed and moldability of each of the resultant powders was examined by compacting the powder.

Each of the powders was prepared according to the procedures including a preparation step of preparing an alloy powder, and a hydrogenation step of heat treatment in a hydrogen atmosphere. In addition, moldability was examined using a coated powder prepared by forming an insulating coating on each of the powder particles formed according to the procedures.

First, an ingot of a rare earth-iron-boron alloy ($Nd_xFe_yB_z$) having each of the compositions shown in Table I (rounded to a significant digit) was prepared and then ground using a cemented carbide mortar in an Ar atmosphere to produce an alloy powder having an average particle diameter of 100 μm (FIG. 1(I)). The average particle diameter was measured as a particle diameter (particle diameter at 50%) at 50% of accumulated weight percentage using a laser diffraction-type particle size distribution analyzer. In addition, the grinding in the nonoxidizing atmosphere such as Ar can effectively prevent oxidation of the powder.

The alloy powder was heat-treated in a hydrogen ($H_2$) atmosphere at 850° C. for 3 hours. The powder (powder for a magnet) produced after the heat treatment (hydrogenation) was fixed with an epoxy resin to prepare a sample for structure observation. The sample was cut or polished at a desired position so as to prevent oxidation of the powder contained in the sample, and the composition of each of the particles constituting the powder for a magnet and present in the cut surface (or the polished surface) was measured using an energy-dispersive X-ray diffraction (EDX) apparatus. In addition, the cut surface (or the polished surface) was observed with an optical microscope or an electron scattering microscope (100 times to 10,000 times) to examine the form of each of the magnetic particles constituting the powder for a magnet. As a result, it was confirmed that as shown in FIG. 1(II), each of the magnetic particles constituting the powder for a magnet includes a phase 2 of an iron-containing material (typically, a phase of iron (Fe) and an iron-boron alloy ($Fe_3B$)) serving as a mother phase, and a plurality of granular phases 3 (typically $NdH_2$) of a hydrogen compound of a rare earth element, which are dispersed in the mother phase, and the phase 2 of the iron-containing material is interposed between the adjacent granules of the hydrogen compound of a rare earth element.

The contents (% by volume) of the hydrogen compound $NdH_2$ of a rare earth element and the iron-containing material Fe, Fe—B of each of the magnetic particles were determined using the sample formed by combining with the epoxy resin. The results are shown in Table I. The contents were each determined by calculating a volume ratio using the composition of the alloy powder used as a raw material and the atomic weights of $NdH_2$, Fe, and $Fe_3B$ on the assumption that a silicone resin described below was present at a certain volume ratio (0.75% by volume). Alternatively, each of the contents can be determined by, for example, calculating a volume ratio from an area ratio determined by the area ratios of $NdH_2$, Fe, and $Fe_3B$ in the area of the cut surface (or the polished surface) of the molded product produced using the powder for a magnet, or by using a peak intensity ratio according to X-ray analysis.

In addition, the distance between the adjacent granules of the hydrogen compound of the rare earth element was measured by surface analysis (mapping data) of the composition of each of the powders using the EDX apparatus. In this case, peak positions of $NdH_2$ were extracted in the surface analysis of the cut surface (or the polished surface), and the distances between the adjacent $NdH_2$ peak positions were measured and averaged to determine an average distance value. The results are shown in Table I.

The powder for a magnet was coated with the silicone resin used as a precursor of a Si—O coated film as an insulating coated film to prepare a powder, and the powder having the insulating coated film was compacted with a hydraulic press under a surface pressure of 10 ton/cm$^2$ (FIG. 1(III)). As a result, each of the powders excluding Sample No. 1-15 could be sufficiently compressed under the surface pressure of 10 ton/cm$^2$ to form a columnar powder compact 4 (FIG. 1(IV)) having an outer diameter of 10 mm and a height of 10 mm. It is considered that Sample No. 1-15 contains an excessively small amount of the iron-containing material phase and is difficult to sufficiently compress, thereby failing to form a powder compact.

The actual density (molding density) and the relative density (actual density relative to the true density) of each of the resultant powder compacts were determined. The results are shown in Table I. The actual density was measured by using a commercial density measuring apparatus. The true density was determined by calculation using the density of $NdH_2$ of 5.96 g/cm$^3$, the density of Fe of 7.874 g/cm$^3$, the density of $Fe_3B$ of 7.474 g/cm$^3$, the density of the silicone resin of 1.1 g/cm$^3$, and the volume ratios shown in Table I.

TABLE I

| Sample | Composition (at %) | | | Estimated volume ratio (%) | | | True | Molding | Relative | Distance |
|---|---|---|---|---|---|---|---|---|---|---|
| | | | | | Fe | Silicone | density | density | density | |
| No. | Nd | Fe | B | $NdH_2$ | Fe—B | resin | g/cm$^3$ | g/cm$^3$ | % | μm |
| 1-1 | 3.0 | 89.8 | 3.4 | 10.2 | 89.1 | 0.75 | 7.58 | 7.29 | 96.2 | 9.8 |
| 1-2 | 5.0 | 86.8 | 4.4 | 16.3 | 82.9 | 0.75 | 7.45 | 7.11 | 95.4 | 6.7 |
| 1-3 | 6.1 | 85.7 | 4.8 | 19.2 | 80.1 | 0.75 | 7.40 | 6.88 | 93.0 | 2.8 |
| 1-4 | 7.6 | 84.5 | 5.2 | 23.1 | 76.1 | 0.75 | 7.32 | 6.69 | 91.4 | 2.4 |
| 1-5 | 9.5 | 83.3 | 5.6 | 27.6 | 71.6 | 0.75 | 7.23 | 6.54 | 90.5 | 1.9 |
| 1-6 | 3.0 | 76.9 | 20.1 | 10.9 | 88.3 | 0.75 | 7.33 | 6.94 | 94.7 | 10.2 |
| 1-7 | 3.8 | 77.4 | 18.9 | 13.3 | 85.9 | 0.75 | 7.31 | 6.78 | 92.8 | 6.3 |
| 1-8 | 6.1 | 78.8 | 15.2 | 19.8 | 79.5 | 0.75 | 7.25 | 6.66 | 91.8 | 2.9 |
| 1-9 | 7.6 | 79.7 | 12.7 | 23.6 | 75.7 | 0.75 | 7.22 | 6.52 | 90.3 | 2.5 |
| 1-10 | 9.5 | 81.0 | 9.5 | 27.9 | 71.4 | 0.75 | 7.18 | 6.44 | 89.7 | 2.2 |
| 1-11 | 11.8 | 82.4 | 5.9 | 32.2 | 67.0 | 0.75 | 7.14 | 6.32 | 88.5 | 1.7 |
| 1-12 | 13.3 | 76.7 | 5.0 | 36.7 | 62.5 | 0.75 | 7.07 | 6.11 | 86.5 | 1.3 |
| 1-13 | 17.3 | 74.7 | 4.0 | 43.7 | 55.5 | 0.75 | 6.95 | 4.92 | 70.8 | 0.9 |
| 1-14 | 24.4 | 71.1 | 2.2 | 53.6 | 45.6 | 0.75 | 6.78 | 4.69 | 69.2 | 0.7 |
| 1-15 | 28.0 | 69.3 | 1.3 | 57.6 | 41.6 | 0.75 | 6.71 | Not moldable | — | — |

Table I indicates that a powder compact with a complicated shape or a high-density powder compact having a relative density of 85% or more can be produced by using a powder containing less than 40% by volume of a hydrogen compound of a rare earth element and the balance substantially composed of an iron-containing material containing Fe and $Fe_3B$, the powder having a structure (phase distance: 3 μm or less) in which the hydrogen compound of a rare earth element is dispersed in the iron-containing material. In particular, it is found that a higher-density powder compact having a relative density of 90% or more can be easily produced by using a powder containing less than 25% by volume of a hydrogen compound of a rare earth element.

Each of the resultant powder compacts was heated to 800° C. in a $H_2$ atmosphere and then the atmosphere was changed to vacuum (VAC) (final vacuum degree: 5 Pa) in which the powder compact was heat-treated at 800° C. for 10 minutes. Since heating was performed in the hydrogen atmosphere, desorption can be started after the temperature becomes sufficiently high, thereby suppressing reaction spots. The composition of each of the cylindrical members produced after the heat treatment was examined by the EDX apparatus. The results are shown in Table II. Table II indicates that each of the cylindrical members includes a rare earth-iron-boron-based alloy material 5 (FIG. 1(V)) substantially composed of a rare earth-iron-boron alloy or a rare earth-iron-boron-based alloy material 5 substantially composed of a plurality of phases of iron and a rare earth-iron-boron alloy, an iron-boron alloy and a rare earth-iron-boron alloy, or a rare earth-iron alloy and a rare earth-iron-boron alloy, and thus hydrogen is removed by the heat treatment.

Each of the resultant rare earth-iron-boron alloy materials was magnetized by a pulsed magnetic field of 2.4 MA/m (=30 kOe), and then the magnetic characteristics of each of the samples produced (rare earth-iron-boron-based alloy magnet 6 (FIG. 1(VI)) were examined using a BH tracer (DCBH tracer manufactured by Riken Denshi Co., Ltd.). The results are shown in Table II. In this case, as the magnetic characteristics, saturation magnetic flux density Bs (T), residual magnetic flux density Br (T), intrinsic coercive force iHc (kA/m), and the maximum product (BH)max (kJ/m$^3$) of magnetic flux density B and magnitude H of demagnetizing field were determined.

TABLE II

| Sample No. | Phase appearing at desorption | Magnetic characteristics Bs T | Br T | iHc kA/m | (BH)max kJ/m$^3$ |
|---|---|---|---|---|---|
| 1-1 | Fe, $Nd_2Fe_{14}B$ | 1.66 | 0.23 | 0.3 | <10 |
| 1-2 | Fe, $Nd_2Fe_{14}B$ | 1.57 | 0.28 | 0.9 | <10 |
| 1-3 | Fe, $Nd_2Fe_{14}B$ | 1.51 | 0.82 | 443 | 113 |
| 1-4 | Fe, $Nd_2Fe_{14}B$ | 1.46 | 0.77 | 518 | 134 |
| 1-5 | Fe, $Nd_2Fe_{14}B$ | 1.42 | 0.73 | 581 | 138 |
| 1-6 | $Fe_3B$, $Nd_2Fe_{14}B$ | 1.45 | 0.18 | 2.3 | <10 |
| 1-7 | $Fe_3B$, $Nd_2Fe_{14}B$ | 1.42 | 0.24 | 4.2 | <10 |
| 1-8 | $Fe_3B$, $Nd_2Fe_{14}B$ | 1.41 | 0.62 | 490 | 105 |
| 1-9 | $Fe_3B$, $Nd_2Fe_{14}B$ | 1.39 | 0.73 | 538 | 147 |
| 1-10 | $Fe_3B$, $Nd_2Fe_{14}B$ | 1.39 | 0.71 | 607 | 148 |
| 1-11 | $Nd_2Fe_{14}B$ | 1.37 | 0.69 | 630 | 141 |
| 1-12 | $Nd_2Fe_{14}B$, Nd—Fe | 1.20 | 0.63 | 642 | 128 |
| 1-13 | $Nd_2Fe_{14}B$, Nd—Fe | 0.92 | 0.46 | 661 | 63 |
| 1-14 | $Nd_2Fe_{14}B$, Nd—Fe | 0.72 | 0.35 | 658 | 39 |

Table II indicates that a rare earth magnet produced using a powder (powder for a magnet) containing less than 40% by volume of a hydrogen compound of a rare earth element and the balance substantially composed of an iron-containing material containing Fe and $Fe_3B$, the distance between the adjacent phases of the hydrogen compound of a rare earth element being 3 μm or less, has excellent magnetic characteristics. In particular, a rare earth magnet having excellent magnetic characteristics can be produced, without sintering, by using a powder containing the iron-containing material at a content of 90% by volume or less or a powder compact having a relative density of 85% or more.

Test Example 2

Rare earth magnets were produced by the same method as in Test Example 1, and magnetic characteristics of the magnets were examined.

In this test, an ingot including, as a main phase (95% by mass or more), a $Nd_2Fe_{14}B$ alloy containing Nd, Fe, and B at an atomic ratio of Nd:Fe:B≈11.8:82.4:5.9 was prepared, and an alloy powder having an average particle diameter of 100 μm was formed by the same method as in Test Example 1. Then, the alloy powder was heat-treated in a hydrogen atmosphere for 1 hour at each of the temperatures shown in Table III. For each of the powders (powder for a magnet) produced after the heat treatment, the contents (% by volume) of $NdH_2$ and the iron-containing material (Fe, Fe—B) and the distance between the adjacent $NdH_2$ phases were determined by the same methods as in Test Example 1. The results are shown in Table III. In addition, the form of each of the particles constituting the powders produced by the heat treatment was examined by the same method as in Test Example 1. As a result, in Sample Nos. 2-3 to 2-6, the $NdH_2$ phase was a granular phase, and in Sample No. 2-2, any of the $NdH_2$ phase, the iron phase, and the iron-boron alloy phase was a layered phase. The alloy powder of Sample No. 2-1 was not subjected to the heat treatment.

Further, an insulating coated film was formed on each of the powders produced after the heat treatment by the same method as in Test Example 1 and then the powder was compacted by the same method as in Test Example 1 to form a powder compact. As a result, Sample No. 2-1 could not be molded, and Sample No. 2-2 could not be sufficiently molded. The possible reason for this is that the alloy powder cannot be sufficiently disproportionated, and thus the phase of the iron-containing material (Fe, Fe—B) cannot be sufficiently produced.

For each of the resultant powder compacts, the true density, the actual density, and the relative density were determined by the same method as in Test Example 1. The results are shown in Table III.

TABLE III

| Sample No. | Heat treatment temperature (hydrogenation) ° C. | Estimated volume ratio (%) $NdH_2$ | Fe Fe—B | Silicone resin | True density g/cm$^3$ | Molding density g/cm$^3$ | Relative density % | Distance μm |
|---|---|---|---|---|---|---|---|---|
| 2-1 | なし | — | — | — | — | Not moldable | — | — |
| 2-2 | 650 | — | — | — | — | Not moldable | — | — |
| 2-3 | 750 | 32.2 | 67.0 | 0.75 | 7.14 | 6.08 | 85.1 | 0.9 |
| 2-4 | 850 | 32.2 | 67.0 | 0.75 | 7.14 | 6.32 | 88.5 | 1.7 |
| 2-5 | 950 | 32.2 | 67.0 | 0.75 | 7.14 | 6.42 | 89.9 | 2.3 |
| 2-6 | 1050 | 32.2 | 67.0 | 0.75 | 7.14 | 6.59 | 92.3 | 5.6 |

Table III indicates that a powder compact having a higher relative density can be produced by increasing the temperature of hydrogenation. The possible reason for this is that the iron-containing material (Fe, Fe—B) phase can be sufficiently produced by increasing the temperature, thereby enhancing moldability.

Each of the resultant powder compacts was heated to 800° C. in a $H_2$ atmosphere, and then the atmosphere was changed to a vacuum (VAC) (final degree of vacuum: 5 Pa) in which the product was heat-treated at 800° C. for 10 minutes. As a result of subsequent measurement of the compositions by the same method as in Test Example 1, Sample Nos. 2-3 to 2-5 were confirmed to be rare earth-iron-boron alloy materials each substantially composed of $Nd_2Fe_{14}B$.

Further, each of the resultant rare earth-iron-boron alloy materials was magnetized by a pulsed magnetic field of 2.4 MA/m (=30 kOe), and then magnetic characteristics were examined by the same method as in Test Example 1. The results are shown in Table IV.

TABLE IV

| Sample No. | Phase appearing at desorption | Magnetic characteristics Bs T | Br T | iHc kA/m | (BH)max kJ/m$^3$ |
|---|---|---|---|---|---|
| 2-3 | $Nd_2Fe_{14}B$ | 1.32 | 0.74 | 653 | 147 |
| 2-4 | $Nd_2Fe_{14}B$ | 1.37 | 0.69 | 630 | 141 |
| 2-5 | $Nd_2Fe_{14}B$ | 1.39 | 0.62 | 512 | 118 |
| 2-6 | $Nd_2Fe_{14}B$, $Fe_3B$, Fe | 1.49 | 0.36 | 258 | 27 |

Table IV indicates that a rare earth magnet having high coercive force and more excellent magnetic characteristics can be produced, without being sintered, by using a powder (powder for a magnet) containing less than 40% by volume of the hydrogen compound of a rare earth element and the balance substantially composed of the iron-containing material containing iron and an iron-boron alloy, the distance between the adjacent phases of the hydrogen compound of a rare earth element being 3 μm or less, and by adjusting the temperature of hydrogenation to a relatively low value.

Test Example 3

Rare earth magnets were produced by changing the conditions for hydrogenation, and magnetic characteristics of the magnets were examined.

In this test, a powder compact was prepared by the same production method as in Test Example 2 using the same raw material as Sample No. 2-4 in Test Example 2. The specifications (true density, actual density, and relative density) of the prepared powder compact are shown in Table V. The true density, etc were measured by the same method as in Test Example 1.

TABLE V

| Sample No. | Heat treatment temperature (hydrogenation) ° C. | Estimated volume ratio (%) $NdH_2$ | Fe Fe—B | Silicone resin | True density g/cm$^3$ | Molding density g/cm$^3$ | Relative density % | Distance μm |
|---|---|---|---|---|---|---|---|---|
| 3-l~3-9 | 850 | 32.2 | 67.0 | 0.75 | 7.14 | 6.32 | 88.5 | 1.7 |

Each of the resultant powder compacts was heated to 800° C. in a $H_2$ atmosphere, and then the atmosphere was changed to a vacuum (VAC) while a magnetic field of 0 T to 8 T was applied from the outside so that each molded product was heat-treated (desorption) in the vacuum (VAC) (final degree of vacuum: 5 Pa) at 800° C. for 10 minutes while the magnetic field shown in Table VI was applied. The magnetic field was applied using a superconducting coil. As a result of determination of the composition of each sample produced after the heat treatment, it was confirmed that like Sample No. 2-4, any of Sample Nos. 3-1 to 3-9 is a rare earth-iron-boron alloy material substantially composed of $Nd_2Fe_{14}B$.

Each of the resultant rare earth-iron-boron alloy materials was magnetized with a pulsed magnetic field of 2.4 MA/m (=30 kOe), and then magnetic characteristics of the materials were examined by the same method as in Test Example 1. The results are shown in Table VI.

In addition, in each of the rare earth-iron-boron alloy materials, a surface having a normal direction parallel to the direction in which the magnetic field was applied during the desorption was cut out as an observation surface and then polished while being immersed in an alcohol so that the surface layer of the observation was not oxidized, forming an observation sample with no processing distortion produced by cutting. The polished surface (observation surface) of each of the thus-formed observation samples was measured with respect to an X-ray diffraction pattern of $Nd_2Fe_{14}B$ crystals according to JIS K 0131 (1996), and the maximum peak intensity, reference intensity Imax, of each of the observation samples was determined. In addition, the intensity of a peak corresponding to the (006) plane (interplanar spacing: about 0.203 nm) of each of the observation samples was measured, and the ratio (relative intensity), (Ix/Imax)×100, of the measured intensity Ix of each observation sample to the reference intensity Imax of each observation sample was determined, where Ix was the measured peak intensity corresponding to the (006) plane. The results are shown in Table VI.

TABLE VI

| Sample No. | Magnetic field T | Magnetic characteristics Bs T | Br T | iHc kA/m | (BH) max kJ/m$^3$ | X-ray intensity (006) Relative intensity |
|---|---|---|---|---|---|---|
| 3-1 | 0 | 1.37 | 0.69 | 630 | 141 | 19 |
| 3-2 | 1 | 1.37 | 0.70 | 620 | 143 | 19 |
| 3-3 | 2 | 1.36 | 0.68 | 640 | 140 | 23 |
| 3-4 | 3 | 1.37 | 0.74 | 650 | 147 | 29 |
| 3-5 | 4 | 1.37 | 0.86 | 640 | 178 | 71 |
| 3-6 | 5 | 1.37 | 0.89 | 660 | 182 | 72 |
| 3-7 | 6 | 1.38 | 0.88 | 650 | 180 | 74 |
| 3-8 | 7 | 1.38 | 0.92 | 670 | 186 | 76 |
| 3-9 | 8 | 1.38 | 0.95 | 670 | 193 | 79 |

Table VI indicates that a rare earth magnet having more excellent magnetic characteristics (here, particularly Br and (BH)max) can be produced by desorption while applying a magnetic field of 4 T or more. Also, it is found that the higher the applied magnetic field, the more the magnetic characteristics can be improved. It is further found that the rare earth magnet has a relative intensity of 70 or more and constant orientation (here, mainly (006) plane orientation), and that the higher the applied magnetic field, the higher the relative intensity.

In addition, the above-described embodiments can be appropriately changed without deviating from the gist of the present invention and is not limited to the above-described configuration. For example, the type of the rare earth element, the average particle diameter of the powder for a magnet, the relative density of the powder compact, and various heat treatment conditions (heating temperature and retention time) can be appropriately changed.

INDUSTRIAL APPLICABILITY

A powder for a magnet of the present invention and a powder compact and a rare earth-iron-boron-based alloy material which are produced using the powder can be preferably used as raw materials for permanent magnets used for various motors, particularly high-speed motors provided in a hybrid electric vehicle (HEV) and a hard disk drive (HDD). A method for producing a powder for a magnet of the present invention and a method for producing a rare earth-iron-born-based alloy material of the present invention can be preferably used for producing the powder for a magnet of the present invention and the rare earth-iron-boron-based alloy material of the present invention.

REFERENCE SIGNS LIST

1 magnetic particle
2 phase of iron-containing material
3 phase of hydrogen compound of rare earth element
4 powder compact
5 rare earth-iron-boron-based alloy material
6 rare earth-iron-boron-based alloy magnet

The invention claimed is:

1. A powder compact produced by compacting the powder for a magnet, comprising:

each of magnetic particles constituting the powder for the magnet being composed of less than 40% by volume of a hydrogen compound of a rare earth element, an iron-containing material, and the balance composed of unavoidable impurities, wherein:

said hydrogen compound of the rare earth element consists of the rare earth element and hydrogen;

the iron-containing material consists of iron and an iron-boron alloy consisting of iron and boron;

a phase of the hydrogen compound of the rare earth element and a phase of the iron-containing material are present adjacent to each other;

the distance between the phases of the rare earth element hydrogen compound adjacent to each other with the phase of the iron-containing material interposed therebetween is 3 μm or less;

the relative density of the powder compact is 85% or more; and the phase of the hydrogen compound is granular, and the granular hydrogen compound of a rare earth element is dispersed in the phase of the iron-containing material.

2. A rare earth-iron-boron-based alloy material produced by heat-treating the powder compact according to claim 1 in an inert atmosphere or a reduced-pressure atmosphere.

3. A rare earth-iron-boron-based alloy material produced by heat-treating the powder compact according to claim 1 in an inert atmosphere or a reduced-pressure atmosphere, the alloy material comprising a mixed-phase material including a rare earth-iron-boron alloy phase and at least one phase selected from an iron phase, an iron-boron alloy phase, or a rare earth-iron alloy phase.

4. A rare earth-iron-boron-based alloy material produced by heat-treating the powder compact according to claim 1 in an inert atmosphere or a reduced-pressure atmosphere while applying a magnetic field of 4 T or more, wherein in an X-ray diffraction pattern measured for a surface having a normal direction parallel to the direction in which the magnetic field is applied, the relative intensity of a diffraction peak appearing at a crystal interplanar spacing of 0.202 nm to 0.204 nm is 70 or more.

* * * * *